US007994424B2

(12) United States Patent
Emilsson

(10) Patent No.: US 7,994,424 B2
(45) Date of Patent: Aug. 9, 2011

(54) COOLING OF HIGH VOLTAGE DEVICES

(75) Inventor: David Emilsson, Ludvika (SE)

(73) Assignee: ABB Technology Ltd., Zürich (CH)

( * ) Notice: Subject to any disclaimer, the term of this patent is extended or adjusted under 35 U.S.C. 154(b) by 0 days.

(21) Appl. No.: 12/667,536

(22) PCT Filed: Jun. 12, 2008

(86) PCT No.: PCT/EP2008/057351

§ 371 (c)(1),
(2), (4) Date: Jan. 4, 2010

(87) PCT Pub. No.: WO2009/003813

PCT Pub. Date: Jan. 8, 2009

(65) Prior Publication Data

US 2010/0175905 A1 Jul. 15, 2010

(30) Foreign Application Priority Data

Jul. 4, 2007 (SE) ..... 0701641

(51) Int. Cl.
*H01B 17/54* (2006.01)

(52) U.S. Cl. ..... 174/15.3; 174/11 BH; 174/16.3; 174/547; 361/676; 361/688

(58) Field of Classification Search ..... 174/15.3, 174/11 BH, 16.3, 17 LF, 547, 548, 142, 152 R, 174/15.1, 73.1; 361/676, 677, 679.46, 679.49, 361/689, 688, 699

See application file for complete search history.

(56) References Cited

U.S. PATENT DOCUMENTS 3,564,386 A * 2/1971 Leonard ..... 174/15.3
4,169,965 A 10/1979 Cronin
4,358,631 A 11/1982 Matsuda

FOREIGN PATENT DOCUMENTS

WO WO 2007/078226 7/2007
WO WO 2007/078238 7/2007

OTHER PUBLICATIONS

PCT/ISA/210—International Search Report—Jan. 12, 2008.
PCT/IPEA/409—International Preliminary Report on Patentability—Jun. 23, 2009.

* cited by examiner

*Primary Examiner* — Angel R Estrada
(74) *Attorney, Agent, or Firm* — Venable LLP; Eric J. Franklin

(57) ABSTRACT

A high voltage system including a HVDC valve, a liquid fluid cooling system for cooling the valve, and a high voltage bushing for transferring high voltage and high current from the fluid cooled HVDC valve. The high voltage bushing includes an insulating body surrounding an electrical conductor electrically connectable to a connector of the HVDC valve. The electrical conductor of the high voltage bushing includes a cooling duct arranged for cooling the bushing utilizing a circulating gaseous fluid. A heat exchanger is connected to the cooling duct and adapted to cool the circulating gaseous fluid, wherein the heat exchanger is connected to the cooling system of the HVDC valve and adapted to receive cooling water from and to return heated cooling water to the cooling system of the HVDC valve.

13 Claims, 4 Drawing Sheets

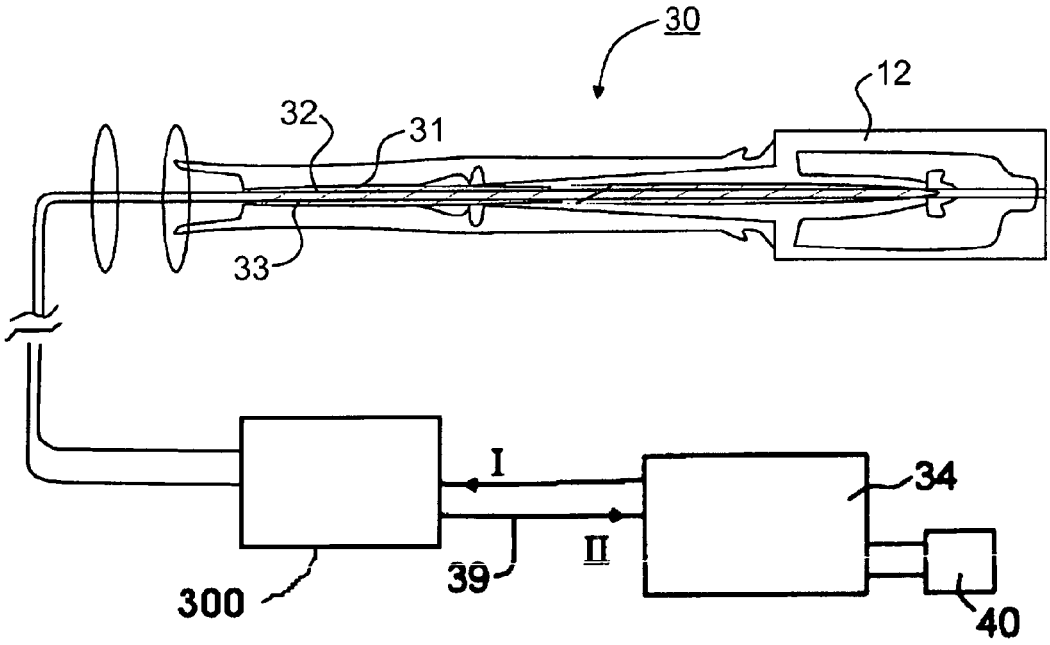
Fig. 3
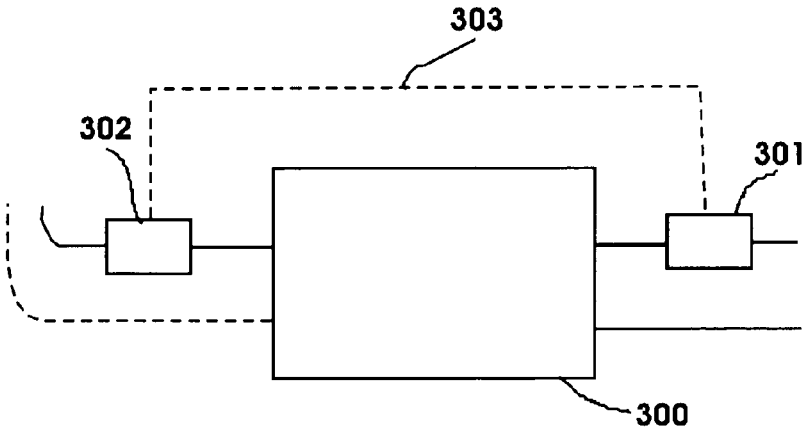
Fig. 3.a

COOLING OF HIGH VOLTAGE DEVICES

CROSS-REFERENCE TO RELATED APPLICATIONS

This application claims priority to Swedish patent application 0701641-3 filed 4 Jul. 2007 and is the national phase under 35 U.S.C. §371 of PCT/EP2008/057351 filed 12 Jun. 2008.

FIELD OF THE INVENTION

The present invention relates to the field of electrical power distribution systems and cooling of high voltage devices in such power distribution systems. In particular, the invention relates to cooling of bushings utilized within such systems. The invention is also related to a corresponding method.

BACKGROUND OF THE INVENTION

Electrical equipment and devices, and in particular high voltage equipment in an electrical power distribution system, have high heat dissipation and therefore require adequate cooling. For example, a conventional HVDC (High-Voltage Direct Current) converter valve may be air insulated and water-cooled. A cooling system is conventionally provided comprising for example cooling water distribution pipes that are shaped to fulfill certain requirements. Another example of an external cooling system is the use of fans.

However, there are also electrical devices within a power distribution system that are not cooled by any external cooling system, such as the above-mentioned water distribution pipes. Those devices, lacking an external cooling system, are then instead just self-cooled, i.e. natural convective air-cooling. One example of such a self-cooled device is a converter transformer bushing.

Typical voltage levels within electrical power distribution systems range up to about 500 kV DC. However, the voltage levels increases constantly and may amount to as much as 800 kV DC and presumably even higher voltage levels in the future. Also, current levels may be up to 4000-5000 A or even higher. Naturally, such high voltages and current levels result in still higher heat dissipation and the requirements on electrical insulation of a bushing become extremely high. The size of the electrical insulation limits the cooling efficiency of the bushing, since the heat has to be led a longer distance to the ambient cooling air due to its increased size. The self-cooling is thus rendered insufficient at the very high voltage and current levels.

It would be feasible to utilize larger conductors when increasing the voltage levels, thereby lowering the heat dissipated, but this would again entail enlarging the equipment. That is, the size of the insulation would still be large.

In view of the above, it would be desirable to enable improved cooling of high voltage devices, such as high voltage bushings. Further, it would also be desirable to provide a corresponding method for cooling such bushings.

In pending (not yet published) PCT application SE2006/000977 filed Aug. 25, 2006, a water based cooling system of a high voltage bushing is described.

SUMMARY OF THE INVENTION

It is an object of the present invention to provide an improved cooling of high voltage devices, and in particular gaseous fluid cooling of bushings within an electrical power distribution system. In particular, it is an object of the invention to provide external cooling means of a bushing, thereby overcoming or at least alleviating the above-mentioned drawbacks of the prior art. By using gaseous medium as cooling medium such as dry air or other suitable cases, risk of liquid fluid leakages in the high voltage environment is eliminated.

It is another object of the present invention to provide an improved cooling of bushings that is adequate also for very high voltages and currents. In particular, it is an object of the present invention to provide external cooling means able to handle high voltages and currents.

It is yet another object of the present invention to provide cooling means for cooling bushings without increasing the size of the constituent parts when increasing the dissipated power in the bushing by increasing the current and voltage levels.

These objects, among others, are achieved by a high voltage bushing and by a method.

In accordance with the invention a high voltage bushing for transferring high voltage and current from a liquid fluid-cooled HVDC valve is provided. The high voltage bushing comprises an insulating body surrounding an electrical conductor, wherein the electrical conductor is electrically connectable to a connector of the HVDC valve. In accordance with the invention, the electrical conductor of the high voltage bushing comprises a cooling duct for gaseous fluid which via a heat exchanger is connectable to a liquid cooling system of the HVDC valve. The inventive way of cooling bushings by utilizing already existing and utilized cooling fluid which via a heat exchanger is transferred to a gaseous fluid enables a cost-efficient and reliable cooling, enabling cooling of the bushing with a gaseous fluid.

By means of the invention the design of a bushing is significantly simplified, as the temperature of the conductor and the insulation material of the bushing is kept under control. In particular, the size of the bushings does not increase although utilizing higher currents and voltages. Further, adequate cooling of bushings is accomplished even for high currents and high voltage levels, for example ranging from 500 kV DC up to 800 kV DC and further up to very high voltage levels.

In accordance with an embodiment of the invention, the electrical conductor of the high voltage bushing comprises a cooling duct having one or more fluid channels. Such fluid channels could be separate channels in fluid connection with each other in at least one point and arranged to receive circulating cooling gaseous fluid trough the electrical conductor cooled via the heat exchanger by the liquid fluid on high electric potential from the HVDC valve. The high voltage bushing may thus be connected to the liquid fluid cooling system of the HVDC valve via the heat exchanger by means of the one or more fluid channels.

Further, the one or more gaseous fluid channels are preferably integrated with the electrical conductor of the high voltage bushing. A size and cost-efficient solution is thereby provided.

In accordance with another embodiment of the invention, the electrical conductor comprises an internal fluid pipe, whereby separate channels are provided. The pipe is arranged to lead cooling gaseous fluid in one direction within its interior, and the fluid is led back through the channels created between the outside of the fluid pipe and the cooling duct of the electrical conductor. Simple means for circulating the cooling fluid is thereby provided.

In accordance with another embodiment of the invention, there is provided a turbine driven by the liquid cooling fluid, which turbine is arranged to drive a gas pump for circulating the gaseous fluid from the heat exchanger to the bushing an back to the heat exchanger.

The invention also comprises such method, whereby advantages corresponding to the above are achieved.

Further characteristics, advantages and objects of the invention will become apparent when reading the following detailed description.

BRIEF DESCRIPTION OF THE DRAWINGS

FIG. 3 illustrates schematically, by way of example an embodiment of the present invention.

FIG. 3*a* illustrates schematically, by way of example an embodiment of the present invention.

DETAILED DESCRIPTION OF PREFERRED EMBODIMENTS

Figure 1:
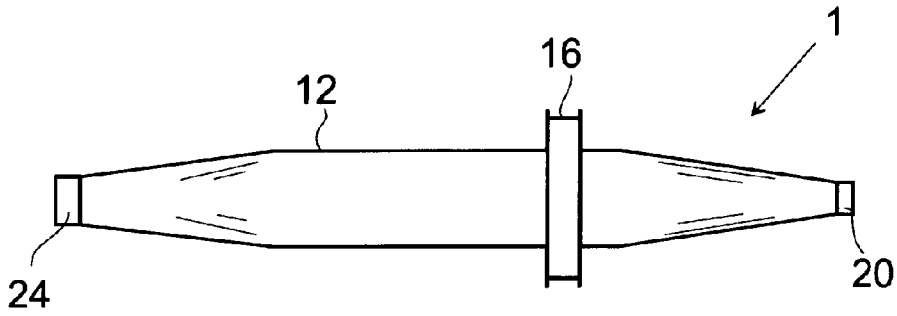
Fig. 1 Prior Art
FIG. 1 is an overall view of a prior art high voltage bushing.

When applicable the same reference numerals are used throughout the description for denoting same or similar parts.

A high voltage bushing is a device used to carry current at high potential through a grounded barrier, for example a wall or an enclosure of an electrical apparatus such as a transformer tank. The bushing keeps current from passing into the grounded barrier by virtue of its insulating properties.

Figure 2:
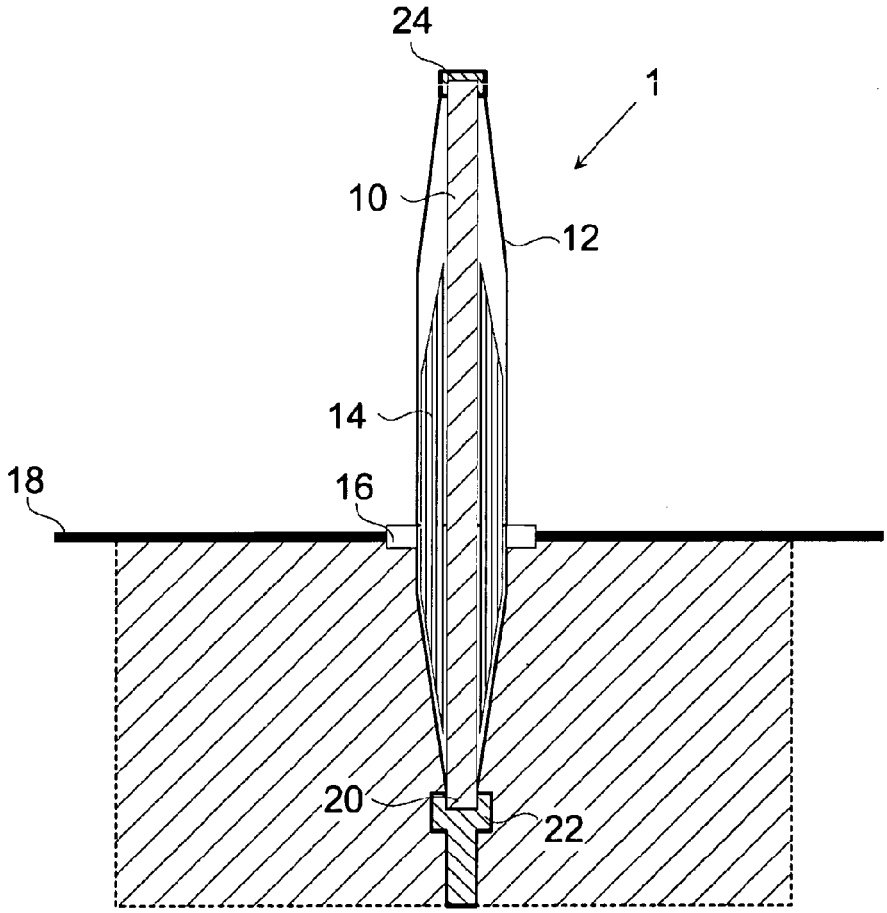
Fig. 2 Prior Art
FIG. 2 is a cross-sectional view of the bushing of FIG. 1 assembled to a transformer housing.

A conventional bushing is shown in FIGS. 1 and 2, wherein the overall structure of a bushing 1 is shown in FIG. 1. In FIG. 2, a cross-sectional view of the bushing 1 of FIG. 1 is shown mounted to a transformer housing 18. A high voltage conductor 10 runs through the center of a hollow bushing insulator 12, which forms a housing around the high voltage conductor 10. Typically, for an open air application the insulator 12 is made of either porcelain or silicone rubber.

In a condenser bushing, a condenser core 14 is provided within the insulator housing for voltage grading. The voltage stress on the bushing and its surrounding structure includes both AC and DC components. AC component voltage grading depends on the insulation material permittivity. DC component voltage grading depends on the temperature dependent resistivity of the insulation materials. A flange 16 is provided to connect the housing 12 of the bushing to ground through a transformer housing 18. Although a condenser bushing is illustrated in the figure, it is realized that the present invention could be utilized in a non-condenser bushing as well.

The connection of the bushing 1 to internal components of a transformer is also indicated schematically in FIG. 2. The exemplary connection comprises a bottom contact 20 formed by the bottom end portion of the high voltage conductor 10. The bottom contact 20 is provided at the lower, bottom end of the bushing 1 and is arranged to be connected to a mating internal contact 22 provided in the transformer housing 18. Further, an upper outer terminal 24 is provided at the end of the bushing 1 opposite the bottom contact 20 end. The outer terminal 24 is electrically connected to the high voltage conductor 10 through an essentially planar interface and is provided in order to electrically connect the transformer device to external sources. It is realized that any other suitable connection means for connecting the bushing to other electrical apparatuses may be utilized.

FIG. 3 illustrates schematically an embodiment of the present invention. In particular, the figure illustrates a bushing 30 in accordance with the present invention. The bushing 30 may be a bushing as described above or any other high voltage bushing. A high voltage conductor 31 is housed within the bushing 30. In accordance with the invention, the high voltage conductor 31 of the bushing 30 is provided with one or more channels 32 for conducting cooling gaseous fluid, in the present example cooling dry air, to be described more in detail with reference to FIGS. 4 and 5.

Conventionally, HVDC valves are cooled by deionized water circulated in a closed loop system. The heat is transferred to a secondary circuit which may be cooled in outdoor coolers. The present invention may be implemented in connection with a HVDC valve that uses deionized water as cooling medium.

In FIG. 3, a HVDC valve is schematically illustrated and is indicated by reference numeral 34. Water pipes of the cooling system of the HVDC valve 34 are indicated by reference numeral 39. The arrows I and II indicate the direction of the cooling water. In particular, at I cooling water from the HVDC valve 34 is led to the heat exchanger 300, and at II, slightly heated cooling water returns to the HVDC valve cooling system. As is well known within the field, the cooling system of the HVDC valve 34 may further comprise a deionizer, a pump, a heat exchanger etc. Such parts of the cooling system are schematically indicated at 40. In the heat exchanger 300, circulation air from the bushing is cooled.

In FIG. 3*a* is schematically illustrated the cooling system (39, 40) comprising a turbine (301) arranged to be driven by the liquid in the liquid fluid cooling system, and the gaseous fluid system comprises a gas pump (302) for circulation of the gaseous fluid, and that said gas pump (302) is driven by said turbine (301) by means of a transmission illustrated by 303.

The cooling liquid fluid of the HVDC valve 34 can be at the same or a different electrical potential as the conductor 31 of the bushing 30. In accordance with the invention only a fraction of the water used to cool the HVDC valve 34 is used to cool the bushing 30 by the gaseous fluid via the heat exchanger 300. For example, the fraction of the water could range from $1/5000$ up to $1/500$, although more or less water may be needed in dependence on the particular application.

Figure 4:
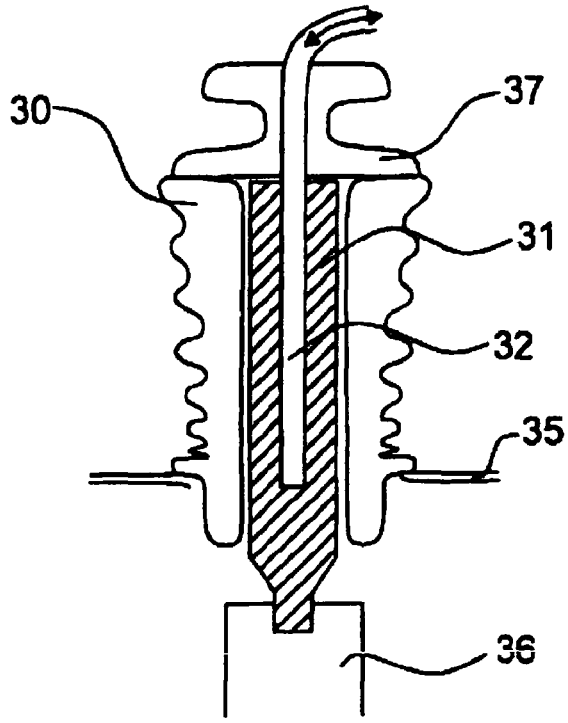
FIG. 4 illustrates the conductor of FIG. 3 within a bushing.

FIG. 4 illustrates the conductor 31 of FIG. 3 within the bushing 30. Reference numeral 35 indicates a grounded housing, for example a transformer tank or a wall. Reference numeral 36 indicates connection means for connecting the bushing 30 to encapsulated electrical apparatus, such as to internal components of a transformer. Reference numeral 37 indicates the connection to, for example, a high voltage network. The bushing 30 could thus serve for connecting an encapsulated electrical apparatus to a high voltage network, although other applications are conceivable. At 32 the gaseous cooling means are shown, and the double-headed arrow in the top part of the bushing 30 indicates flowing cooling gaseous fluid.

Figure 5:
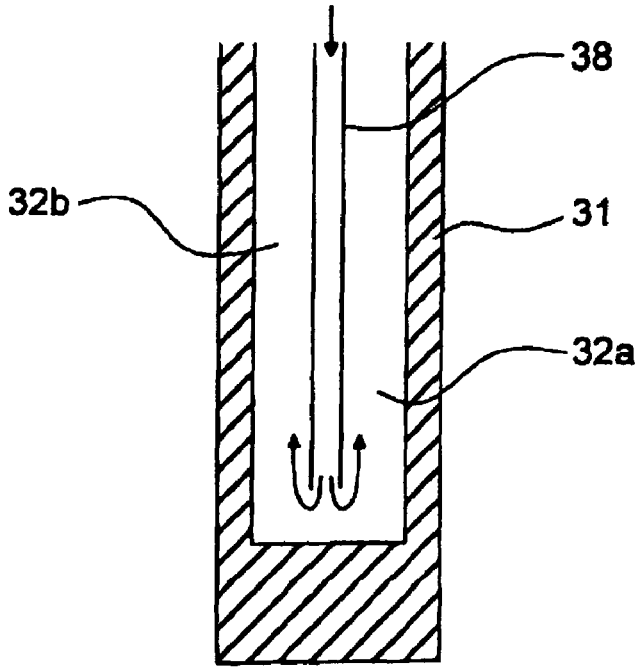
FIG. 5 illustrates the conductor and embodiments of the cooling channels more in detail.

FIG. 5 illustrates the conductor 31 of the high voltage bushing 30 and the cooling ducts in more detail. One or more cooling ducts 32 are provided integrated with the conductor 31. A pipe 38 is preferably provided within the cooling duct 32. Cooling gaseous fluid may then be led through the pipe 38, allowing gaseous fluid to enter within the pipe 38 and led out on the outside of the pipe 38. That is, the pipe 38 is arranged to lead cooling gaseous liquid in one direction within the pipe 38, and the gaseous liquid is then led through channels 32*a*, 32*b* created between the outside of the pipe 38 and the interior of the cooling duct 32.

The hollow interior of the conductor 31 housing the cooling duct 32, is preferably not a through hole, thereby reducing the risk of gaseous liquid migrating to electrical devices such as a transformer. The one or more cooling channels 32*a*, 32*b* are connected to the cooling system for cooling the HVDC valves via the heat exchanger 300.

In accordance with one embodiment of the invention, the temperature of the conductor 31 is approximately kept within the range of 40° C. to 80° C., preferably around 60° C. It is realized that the temperature can be supervised and kept at other temperatures as well.

Figure 6:
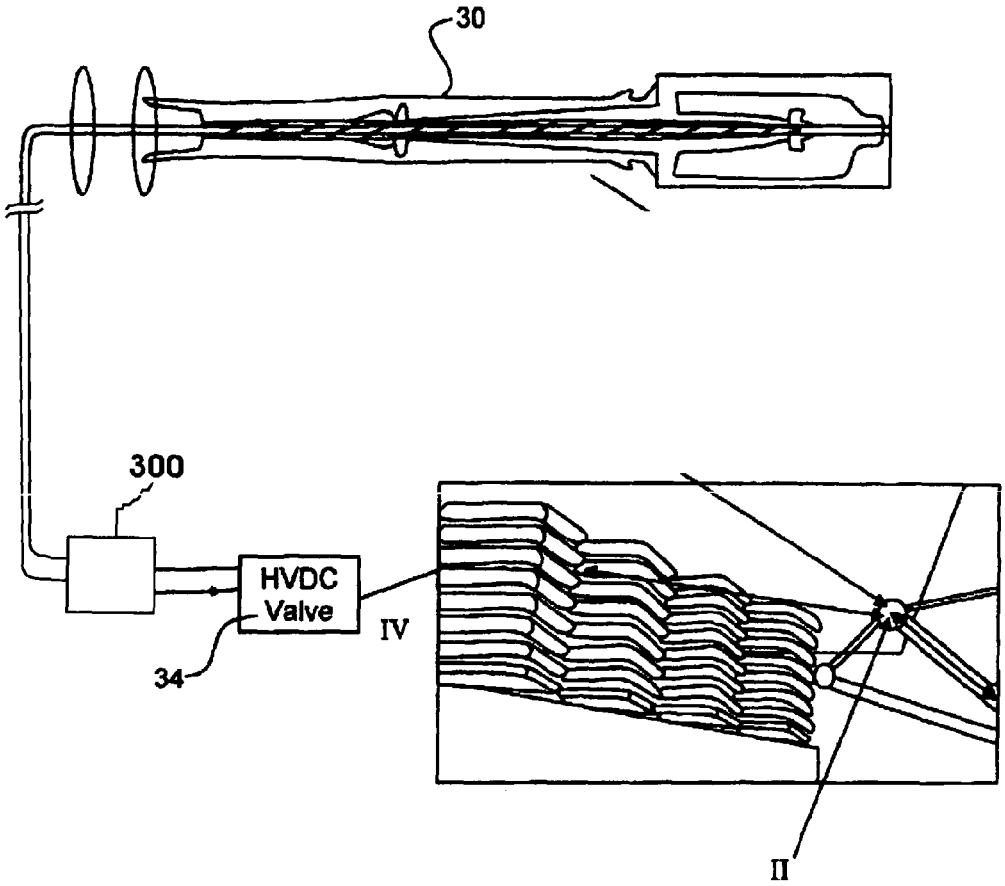
FIG. 6 illustrates by way of example a valve hall in which the present invention may advantageously be implemented.

FIG. 6 illustrates a HVDC valve hall, and shows schematically how the present invention could easily be implemented in such application. HVDC converter transformers are connected to the HVDC valve by means of a converter transformer bushing. Conventionally, the converter transformer is arranged directly outside the HVDC valve hall with its bushings penetrating into the valve hall. The top of the bushing is then directly connected to the HVDC valve. Arrow II indicates electrical and cooling water connection. Arrow IV indicates one of several HVDC valves within the valve hall.

The inventive way of cooling bushings by utilizing already existing and used cooling water via a heat exchanger enables a cost-efficient and reliable cooling. By means of the invention the design of a bushing will be significantly simplified, as the temperature of the conductor and the insulation material of the bushing is kept under control. For higher voltages, for example 800 kV DC, a prior art bushing would have to become very big in order to carry for example 4000 A. The inventive cooling of the bushing gives a lower diameter of the conductor and thereby a reduced size of the whole bushing.

Further, adequate cooling of bushings is accomplished even for high currents and high voltage levels, for example ranging from 500 kV DC up to 800 kV DC and further up to very high voltage levels.

The present invention is applicable, for example, for a converter transformer bushing, a valve hall wall bushing and an indoor smoothing reactor bushing.

In the preceding detailed description, the invention is described with reference to specific exemplary embodiments thereof. Various modifications and changes may be made thereto without departing from the scope of the invention as set forth in the claims. The specification and drawing are, accordingly, to be regarded in an illustrative rather than a restrictive sense. Thus, although water has been described as a preferred cooling liquid fluid, oil is a possible alternative to that.

As cooling gaseous fluid, dry air can be used, but also other suitable cases, preferable other environmentally friendly gases such as nitrogen.

The invention claimed is:

1. A high voltage system, comprising:

a high voltage direct current valve;

a liquid fluid cooling system for cooling the valve;

a high voltage bushing for transferring high voltage and high current from the fluid cooled high voltage direct current valve, said high voltage bushing comprising an insulating body surrounding an electrical conductor electrically connectable to a connector of said high voltage direct current valve, wherein said electrical conductor of said high voltage bushing comprises a cooling duct arranged for cooling the bushing utilizing a circulating gaseous fluid; and a heat exchanger connected to the cooling duct and adapted to cool the circulating gaseous fluid, wherein the heat exchanger is connected to the cooling system of the high voltage direct current valve and adapted to receive cooling water from and to return heated cooling water to the cooling system of said high voltage direct current valve.

2. The high voltage system according to claim 1, wherein said cooling duct comprises at least two separate channels, which are in fluid connection with each other at least in one point and arranged to receive circulating cooling gaseous fluid, which is cooled via the heat exchanger by the liquid fluid on high electric potential from said high voltage direct current valve.

3. The high voltage bushing system according to claim 1, wherein said cooling duct is integrated with said electrical conductor of said high voltage bushing.

4. The high voltage system according to claim 1, wherein said high voltage bushing is connectable to said liquid fluid cooling system of said high voltage direct current valve via the heat exchanger with said one or more gaseous fluid channels.

5. The high voltage bushing system according to claim 1, wherein said cooling duct of said electrical conductor comprises a fluid pipe arranged to lead cooling gaseous fluid.

6. The high voltage bushing system according to claim 1, wherein said high voltage bushing is arranged for transferring high voltage and current through at least one grounded plane to a transformer.

7. The high voltage bushing system according to claim 1, wherein the temperature of said electrical conductor is kept within the range of 40° C. to 80° C.

8. The high voltage bushing system according to claim 1, wherein a fraction of the cooling liquid fluid of said high voltage direct current valve cooling system is utilized for cooling the gaseous fluid via the heat exchanger for cooling said high voltage bushing.

9. The high voltage bushing system according to claim 1, wherein the liquid fluid cooling system comprises a turbine arranged to be driven by the liquid in the liquid fluid cooling system, wherein the gaseous fluid system comprises a gas pump for circulation of the gaseous fluid, and wherein said gas pump is driven by said turbine by a transmission.

10. The high voltage system according to claim 9, wherein the heat exchanger, turbine and gas pump and transmission form an integrated unit.

11. The high voltage bushing system according to claim 1, wherein the liquid fluid in the fluid cooling system is water.

12. The high voltage bushing system according to claim 1, wherein the gaseous fluid is air.

13. The high voltage bushing system according to claim 1, wherein the gaseous fluid is nitrogen.

* * * * *